US008875773B2

(12) United States Patent
Reus

(10) Patent No.: US 8,875,773 B2
(45) Date of Patent: Nov. 4, 2014

(54) METHOD AND DEVICE FOR AT LEAST PARTIALLY SEALING A CAVITY, AND APPARATUS, IN PARTICULAR FOR REPAIRING EQUIPMENT HAVING SUCH A DEVICE BUILT THEREIN

(76) Inventor: Pierre Reus, Fontenay le Comte (FR)

( * ) Notice: Subject to any disclaimer, the term of this patent is extended or adjusted under 35 U.S.C. 154(b) by 133 days.

(21) Appl. No.: 13/634,975

(22) PCT Filed: Mar. 29, 2011

(86) PCT No.: PCT/FR2011/050679

§ 371 (c)(1),
(2), (4) Date: Sep. 14, 2012

(87) PCT Pub. No.: WO2011/121221

PCT Pub. Date: Oct. 6, 2011

(65) Prior Publication Data

US 2013/0000200 A1 Jan. 3, 2013

(30) Foreign Application Priority Data

Apr. 2, 2010 (FR) ..... 10 52522
Oct. 6, 2010 (FR) ..... 10 58104

(51) Int. Cl.
*A47G 5/02* (2006.01)
*E04H 4/10* (2006.01)
*E04H 5/06* (2006.01)

(52) U.S. Cl.
CPC . *E04H 5/06* (2013.01); *E04H 4/101* (2013.01)
USPC ..... 160/238; 160/23.1

(58) Field of Classification Search
CPC ... E04F 10/0685; E06B 9/17007; E04H 4/103
USPC ..... 160/23.1, 238, 304
See application file for complete search history.

(56) References Cited

U.S. PATENT DOCUMENTS 3,231,006 A * 1/1966 Fisher et al. ..... 160/41
3,283,806 A * 11/1966 Harris ..... 160/264

(Continued)

FOREIGN PATENT DOCUMENTS

DE 23 54 279 A1 5/1975
FR 2 408 021 A1 6/1979
FR 2 674 565 A1 10/1992

OTHER PUBLICATIONS

International Search Report, dated Jul. 25, 2012, from corresponding PCT application.

*Primary Examiner* — Blair M Johnson
(74) *Attorney, Agent, or Firm* — Young & Thompson

(57) ABSTRACT

A cover device for at least partially closing off a cavity includes at least one cover element for closing off the opening of the cavity, and a support structure in the form of an elongate body for supporting and positioning the cover element in or close to the cavity. The cover element is in the form of a pneumatic mattress equipped with return elements for urging it back into a most compact configuration in which it is rolled up about a free one of its sides and forms a spirally wound roll, the free side being formed by the side of the mattress that is opposite from the connecting side of the mattress via which side the mattress is connected to the support structure. This device includes at least one support arm for supporting the mattress while going from its rolled-up most compact configuration to its rolled-out least compact configuration.

14 Claims, 6 Drawing Sheets

(56) References Cited

U.S. PATENT DOCUMENTS

| | | | | | |
|---|---|---|---|---|---|
| 3,927,727 | A | * | 12/1975 | Hanagan | 180/219 |
| 4,103,368 | A | * | 8/1978 | Lockshaw | 126/566 |
| 4,262,373 | A | | 4/1981 | Chambers | |
| 4,341,253 | A | | 7/1982 | Eyerle | |
| 4,471,500 | A | * | 9/1984 | Long et al. | 4/499 |
| 4,628,646 | A | * | 12/1986 | Eyerle | 52/71 |
| 5,085,473 | A | * | 2/1992 | Yang | 296/141 |
| 5,738,160 | A | * | 4/1998 | Rice | 160/84.06 |
| 6,189,960 | B1 | * | 2/2001 | Mumura et al. | 296/212 |
| 6,843,019 | B2 | * | 1/2005 | Mercurio et al. | 47/17 |
| 2011/0308743 | A1 | * | 12/2011 | Gurdebeke | 160/127 |
| 2013/0000200 | A1 | * | 1/2013 | Reus | 49/33 |
| 2013/0118696 | A1 | * | 5/2013 | Gavish | 160/328 |

* cited by examiner

METHOD AND DEVICE FOR AT LEAST PARTIALLY SEALING A CAVITY, AND APPARATUS, IN PARTICULAR FOR REPAIRING EQUIPMENT HAVING SUCH A DEVICE BUILT THEREIN

BACKGROUND OF THE INVENTION

1. Field of the Invention

The present invention relates to a method and to a device for at least partially closing off an open-top cavity of the pit or pool type, in particular for preventing anything falling into said cavity, and the present invention also relates to an installation, in particular a vehicle repair installation, of the type comprising at least a cavity and a device of the above-mentioned type for closing off the opening of the cavity.

2. Description of the Related Art

Such devices, designed to close off inspection or work pits of the type used by mechanics for repairing vehicles, are well known to persons skilled in the art.

Such a pit is constituted by a cavity in the general shape of a rectangular trough that is sunk into the floor and that is of width less than the widths of the vehicles to be repaired, so that said vehicles can be positioned over the pit along its longitudinal axis. While they are not being used, and for evident safety reasons, the openings of such pits should be closed off. This is usually achieved by laying a series of transverse beams or planks across said pits, with the respective edge faces of the beams or planks being laid against one another so as to form a continuous cover surface of the entire length of the pit.

Currently, in order enable that type of pit to be closed and opened automatically, each cover element is provided on its inside face with rack means suitable for co-operating with pinion means meshing with the rack means and controlled by actuator means. Such rack and pinion means make the resulting assembly complex and costly, as illustrated, for example, by patent FR-2 674 565.

It is also known that such a cover device can comprise at least one cover element for at least partially closing off the opening of the cavity and a support structure for supporting said cover element, which support structure is in the form of an elongate body for positioning the cover element in or close to the cavity, and preferably along one of the sides of the opening of said cavity. Said cover element is in the form of a pneumatic mattress equipped with return means for urging it back into a most compact configuration in which it is rolled up about a free one of its sides and forms a spirally wound roll, said free side about which the mattress is rolled up being formed by the side of the mattress that is opposite from the connecting side of the mattress via which side the mattress is connected to the support structure, said mattress being an inflatable mattress so that, by being rolled out, said mattress can go from its rolled-up most compact configuration, in which it is suitable for at least partially opening up the opening of said cavity, to a rolled-out least compact configuration in which it is suitable for at least partially closing the opening of the cavity.

In such cover devices, more particularly designed for covering over swimming pools, it is not possible, when the cover element is in its rolled-out least compact configuration, for said cover element to be used as a load-bearing floor, because of the design of the device.

BRIEF SUMMARY OF THE INVENTION

An object of the present invention is thus to obtain a cover device of the above-mentioned type in which the design of the cover element makes it possible firstly for the cavity to be closed and to be opened in simple manner without requiring complex mechanical drive elements for moving the cover elements, and secondly for the cover element to be used as a load-bearing floor when said cavity is in the closed state.

Another object of the present invention is to propose a cover device of the above-mentioned type that is designed so as to make it possible to go from the cavity-open position to the cavity-closed position and vice versa, with, as the only energy source, the pressurized fluid source necessary for inflating the cover element.

To this end, the invention provides a cover device for at least partially closing off an open-top cavity of the pit or pool type, in particular for preventing anything falling into said cavity, said device comprising at least one cover element for at least partially closing off the opening of the cavity, and a support structure for supporting said cover element, which structure is in the form of an elongate body for positioning the cover element in or close to the cavity, preferably along one of the sides of the opening of said cavity, said cover element being in the form of a pneumatic mattress equipped with return means for urging it back into a most compact configuration in which it is rolled up about a free one of its sides and forms a spirally wound roll, said free side about which the mattress is rolled up being formed by the side of the mattress that is opposite from the connecting side of the mattress via which side the mattress is connected to the support structure, said mattress being an inflatable mattress so that, by being rolled out, said mattress can go from its rolled-up most compact configuration, in which it is suitable for at least partially opening up the opening of said cavity to a rolled-out least compact configuration in which it is suitable for at least partially closing the opening of the cavity, said cover device being characterized in that said device further comprises at least one support arm for supporting said mattress while it is going from its rolled-up most compact configuration to its rolled-out least compact configuration, said support arm being mounted to move between a stowage position in which it extends substantially parallel to the roll-up axis about which the mattress is rolled up and a working position in which it extends transversely to said roll-up axis.

The choice of a cover element in the form of an inflatable pneumatic mattress makes it possible, merely by inflating it, to close said cavity. It is thus possible to avoid having to provide any complex mechanical drive means for moving the cover elements. The presence of at least one support arm that, in the stowage position, is suitable for extending under the support structure parallel to the longitudinal axis of said support case, and that, in the working position, is suitable for extending transversely to the longitudinal axis of said support structure, under the bearing plane formed by the mattress in the rolled-out least compact configuration, makes it possible, in particular, to use the cover element as a load-bearing floor when it is in the least compact configuration.

Preferably, the or each support arm is equipped with return means for urging said support arm back into its working position, i.e. return means for urging said support arm back into a position in which it extends perpendicularly to the longitudinal axis of the support structure or to the roll-up axis about which the mattress is rolled up, the roll-up axis of the mattress and the longitudinal axis of the support structure generally being substantially parallel.

Also preferably, the or each support arm is caused to move automatically for causing said support arm to go from the stowage position to the working position, and is caused to move manually for causing said support arm to go from the working position to the stowage position.

In other words, the or each support arm is actuated automatically to cause said support arm to go from the stowage position to the working position, and is actuated manually to cause said support arm to go from the working position to the stowage position.

The or each support arm is thus brought back manually into its stowage position by the operator who moves it about its hinge. Generally, the or each support arm is a pivotally mounted arm mounted to pivot about an axis perpendicular to the longitudinal axis of the support structure and to the bearing plane formed by the mattress when said mattress is in its rolled-out least compact configuration.

The support structure is in the form of a case inside which the cover element is inserted at least partially when said cover element is in its rolled-up most compact configuration, said case being provided with an opening through which the cover element projects while it is going from its rolled-up most compact configuration to its rolled-out least compact configuration, the opening of the case being provided with a closure element, such as a flap, mounted to move between a closed position in which it closes said case and an open position in which it opens said case.

This configuration makes it possible to dispose a series of cases forming a line of cases in single file, i.e. one behind the other, along a longitudinal side of the cavity, it being possible for the cover element in each case to be rolled out independently of the other cover elements in the other cases so that a large number of closure or of opening configurations can be obtained for the cavity.

Generally, the closure element is equipped with return means for urging it back into the closed position in which it closes said case and is suitable for going from the closed position to the open position under the effect of the pressure exerted by said mattress on the closure element, while said mattress is being inflated.

The return means thus act against the inflation means of the mattress and tend to urge the closure element back into the closed position.

Preferably, while it is going from its closed position to its open position, this closure element forms the control means for controlling the or each support arm associated with a mattress, so as to cause said arm to go from the stowage position to the working position. As a result, it is possible, merely by inflating the mattress, to cause the closure element and the support arm to move, so as to bring them respectively into the open position and into the working position.

Preferably, the return means for urging the mattress back into the most compact rolled-up configuration are elastically deformable elements, each of which is in the form of an elongate element extending between the free side of the mattress about which side the mattress is suitable for being rolled up in the most compact configuration and the side of the mattress opposite from said free side corresponding to the connecting side of the mattress via which side the mattress is connected to the support structure.

These return means act against the inflation means. These return means make it possible, as soon as the mattress is allowed to deflate, to urge said mattress automatically back into the position in which the cavity is open.

These elongate component elements of the return means, such as spring blades, are elements that, in the absence of any stress, are in the shape of spirally wound coils. These elongate elements of the pre-stressed spring type have a pre-stress force or rating such that the tension imparted to the mattress by it being inflated causes said elements to be deformed, and in particular to be rolled out. Conversely while the mattress is being deflated, the elongate elements tend to return to their initial shape, thereby causing the mattress to be rolled up. The return means thus act against the mattress inflation means and tend to urge the mattress back into its rolled-up position in which it is in the form of a spirally wound roll.

Also preferably, the device further comprises bearing means for bearing against the free side of the mattress, about which side the mattress is rolled up, said bearing means preferably being in the form of one or more elongate elements of the rail type that are positionable along that one of the sides of the opening of said cavity that is opposite from the side of said cavity that receives the support structure so as to form an additional bearing surface against which the mattress can bear. This characteristic also takes part in enabling the cover element to be used as a load-bearing floor.

Generally, the mattress is equipped along its roll-up free side and/or along its connecting side via which it is connected to the support structure, with a rigid element for stiffening said side, thereby further reinforcing said cover element's function as a load-bearing floor.

The invention also provides an installation, in particular a vehicle repair installation, of the type comprising at least a cavity and a cover device for closing off the opening of the cavity, said installation being characterized in that the cover device is a device of the above-mentioned type.

The invention also provides a method of at least partially closing off a cavity of the pit or pool type by means of a device of the above-mentioned type, said method comprising at least:

- a step of fastening the device in the cavity or at a location close to said cavity;
- a step of inflating said pneumatic mattress for causing said mattress to go from its most compact configuration to its least compact configuration in which it at least partially closes off the cavity; and
- when said cavity is in the at least partially closed-off state, and in order to open up the cavity at least partially, a step of allowing the inflatable mattress to deflate in such manner as to enable said mattress to be rolled up via said return means;

said method being characterized in that, during the inflation step, said method further comprises causing the support arm to go from its stowage position to its working position.

In an implementation of the method, in which implementation the or each support arm is equipped with return means for urging the support arm back into the working position and the closure element is equipped with return means for urging it back into the closed position in which it closes said case and is suitable for going from the closed position to the open position under the effect of the pressure exerted by said mattress on the closure element, while said mattress is being inflated, said method further comprises at least, during the inflation step, a stage of causing the closure element of the case to go from the closed position to the open position under the effect of the pressure exerted by the mattress on said closure element, while the volume of the mattress is increasing by it being inflated, the closure element going from the closed position to the open position releasing, when it is in the open position, the or each support arm from any stress so as to enable the arm to go automatically from the stowage position to the working position under the action of the return means equipping the or each support arm.

BRIEF DESCRIPTION OF THE DRAWINGS

The invention can be well understood on reading the following description of embodiments given with reference to the accompanying drawings, in which.

DETAILED DESCRIPTION OF THE PREFERRED EMBODIMENTS

Figure 1:
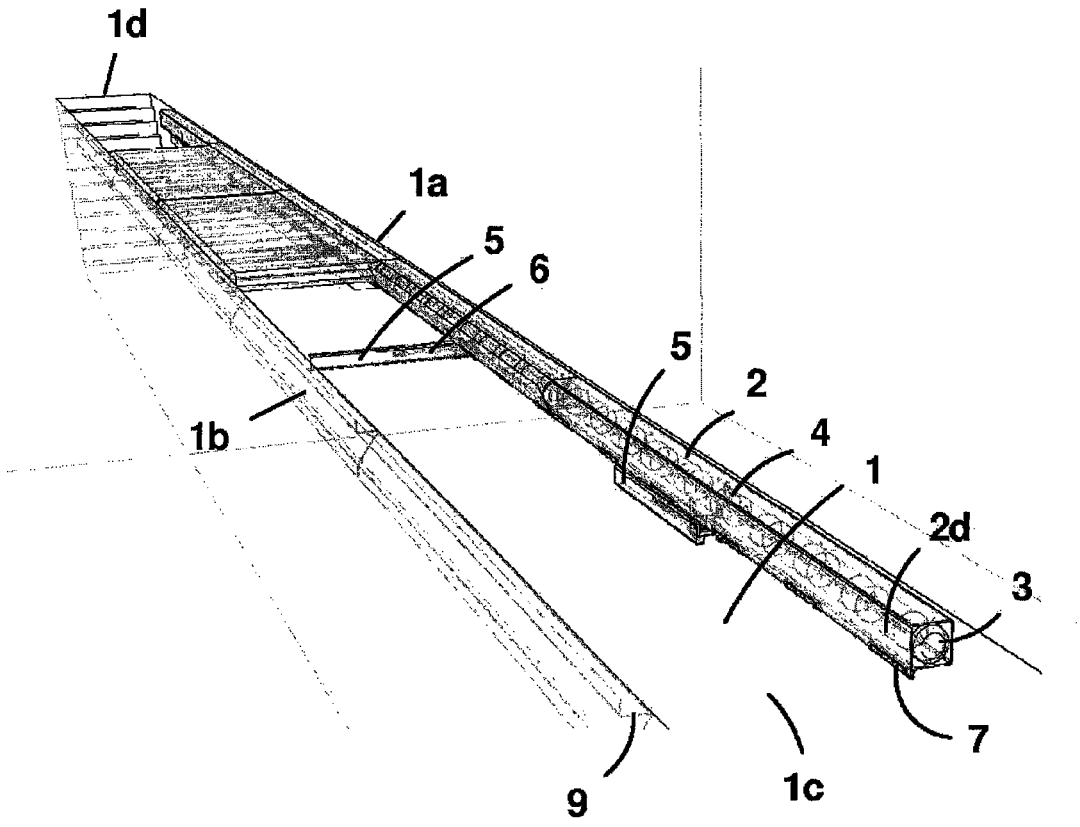
FIG. 1 is a diagrammatic overall view of a cavity of the pit type equipped with cover devices of the invention shown with their cover elements in various configurations.
Figure 2:
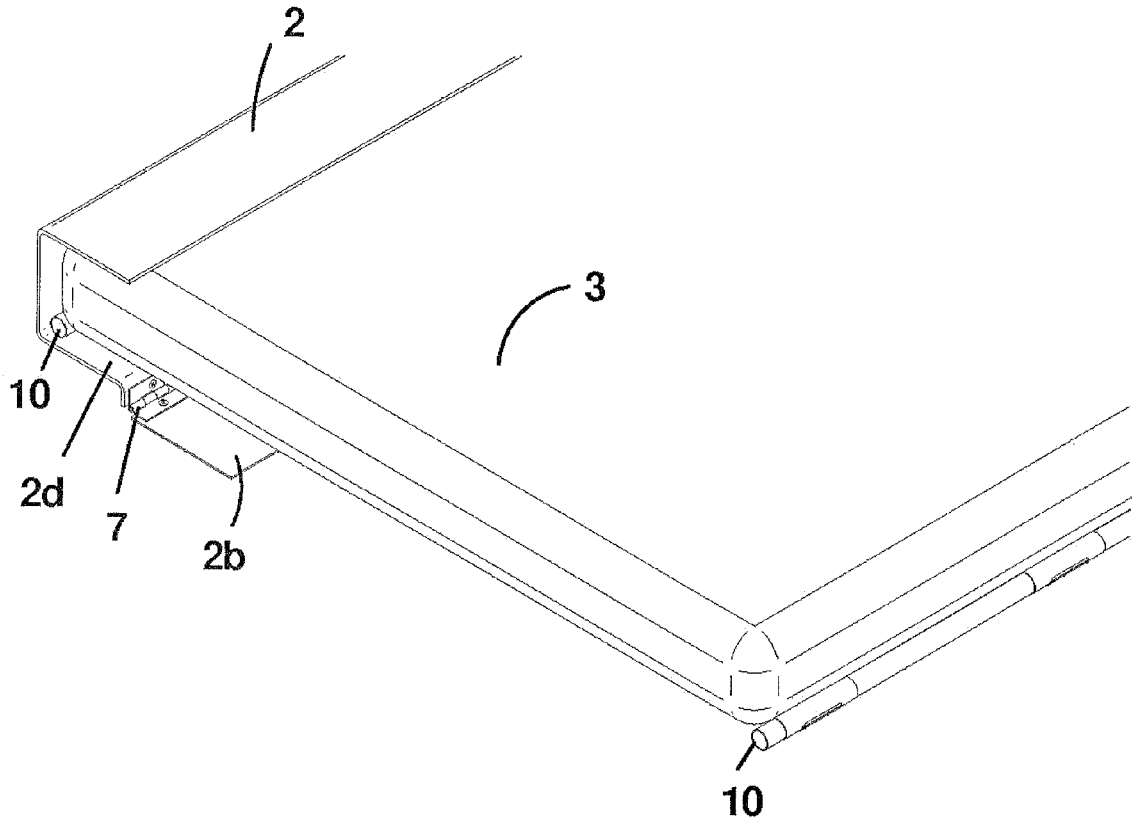
FIG. 2 is a fragmentary view of a cover element and of the associated support structure with the cover element in its least compact configuration, and with the flap of the case in the open state.
Figure 3:
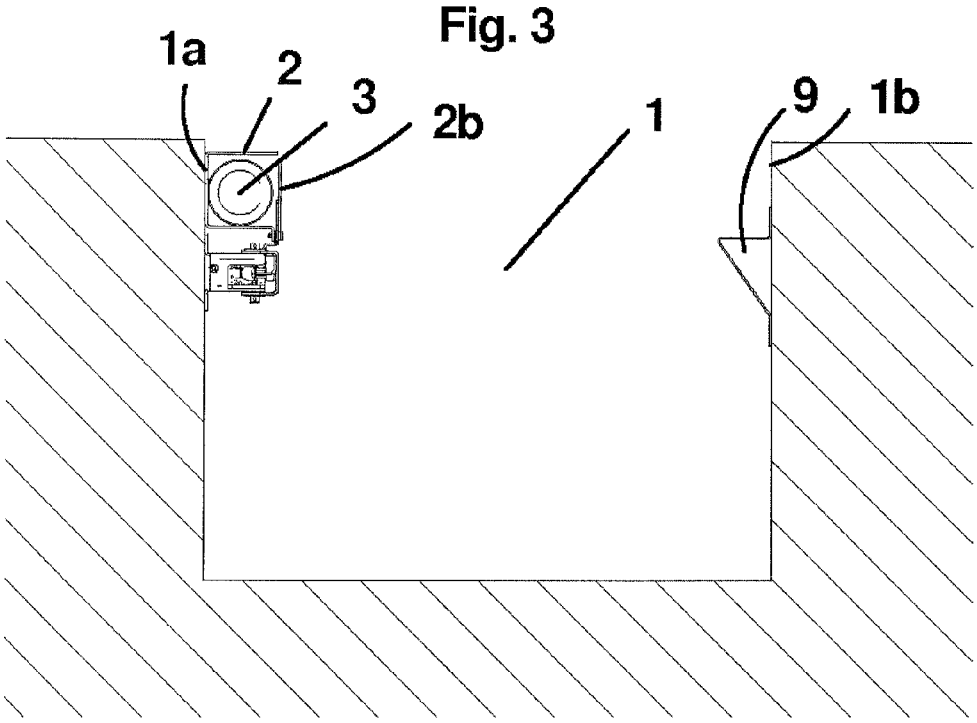
FIGS. 3 to 7 are diagrammatic section views showing the various stages of operation of the device for causing the cover element to go from its most compact configuration to its least compact configuration.

As mentioned above, the device of the invention enables an open-top cavity 1 to be closed off at least partially.

In the examples shown, the cavity is a workshop pit in the form of a sunken cavity that is in the general shape of a rectangular trough, defined by two longitudinal sides 1*a* and 1*b* and two transverse sides 1*c* and 1*d*, the transverse sides generally being equipped with steps giving access to the pit. In equivalent manner, the device could be applied to a pool, e.g. to a swimming pool or a pool of some other type. The objective of such a cover device is to avoid anything falling into the cavity, in particular during periods for which the cavity is not being used, and to be able to use the cover element as a load-bearing floor.

As mentioned above, this device comprises at least one cover element for at least partially closing off the cavity 1, and a support structure 2 for supporting said cover element 3, which support structure is in the form of an elongate body for positioning the cover element 3 in or close to the cavity 1, and preferably along one 1*a* of the sides 1*a*, 1*b* of the opening of said cavity 1, said cover element 3 being in the form of a pneumatic mattress 3 equipped with return means 4 for urging it back into its most compact configuration in which it is rolled up about a free one 3*b* of its sides and forms a spirally wound roll, said free side 3*b* about which the mattress 3 is rolled up being formed by that side of the mattress that is opposite from its connecting side 3*a* via which the mattress 3 is connected to the support structure 2. Said mattress 3 is a mattress that is inflatable so as to go, by said mattress being rolled out, from the "rolled-up" most compact configuration, in which it is suitable for at least partially opening up the opening of the cavity 1, to a "rolled-out" least compact configuration in which it is suitable for at least partially closing off the opening of the cavity 1.

Generally, the cover element, which is designed to close off the top portion of the cavity, is positioned either in the opening plane of said cavity, or slightly above or slightly below said plane. When it extends below said opening plane of the cavity, it is disposed inside the cavity, as it is when it extends in said opening plane. When it is disposed above the opening plane of the cavity, it is, for example, positioned along a longitudinal side of the cavity or in the middle of the cavity and it closes off the cavity by covering over its opening.

In the examples shown, the cover element is, in the most compact configuration, disposed below the opening plane of the cavity 1 and is, with the support structure 2, positioned along the longitudinal side 1*a* of said cavity. It is deployed from said longitudinal side 1*a* towards the other side 1*b* of the cavity so that, when it is in the deployed position, it comes to bear against said other side or against separately mounted bearing means. The device further comprises bearing means 9 for bearing against the free side 3*b* of the mattress 3, about which side the mattress is rolled up, said bearing means 9 preferably being in the form of one or more elongate elements of the rail type that are positionable along the side 1*b* of the opening of said cavity that is opposite from the side of said cavity that receives the support structure 2 so as to form an additional bearing surface against which the mattress 3 can bear.

Generally, in order to enable the cover device to be positioned in the cavity, a rabbet is provided along one of the longitudinal sides, and, in this example, along the side 1*a* of said cavity 1. It should be noted that, in the examples shown, a plurality of cover devices are disposed in alignment along a longitudinal side of the cavity. The cover elements of these devices may be deployed simultaneously or otherwise.

The invention thus also relates to an installation comprising at least one cavity 1 and at least one cover device for closing off the opening of the cavity 1, and preferably a plurality of cover devices for closing off the opening of the cavity 1, which devices are, in the most compact position, preferably disposed in an aligned state along one of the longitudinal sides of said cavity.

The cover element of the or each cover device is formed by at least one roll-up pneumatic mattress 3 deployed by being rolled out so as to cause said mattress to go from the most compact configuration, corresponding to the mattress 3 being in a "rolled-up" state to the least compact configuration, to the least compact configuration, corresponding to the mattress 3 being in a "rolled-out" state, said mattress 3 being suitable for going from its most compact configuration to its least compact configuration merely by being inflated. In order to enable said mattress 3 to be inflated, said mattress is, for example, provided with at least one orifice that is connectable to a compressed air source, such as a compressor.

When a plurality of cover devices are placed in alignment, as shown in the figures, the cover elements of the various devices may be connected to the same compressor, and each of them is equipped with a valve, e.g. a three-port valve, for equipping their orifices so they can allow the mattress to deflate or be connected to the compressed air source of the mattress as a function of the position occupied by the valve. Thus, causing the cavity 1 to go from the open position to the closed position is achieved merely by inflating the mattress.

The mattress is equipped with return means 4 for urging it back into its most compact configuration. In the examples shown, the return means 4 are elastically deformable elements, each of which is the form of an elongate element extending between two opposite sides 3*a*, 3*b* of the mattress 3, one 3*b* of the sides 3*a*, 3*b* constituting the free side of the mattress 3 about which side the mattress 3 is suitable for rolling up into the most compact configuration. These elastically deformable elements may be formed by spring blades that are urged back into a state in which they form spirally wound coils. Each elongate element is fastened to the same face of the mattress, said elements being disposed mutually parallel between the roll-up free side 3*b* of the mattress and its opposite side 3*a* for connecting to the support structure 2. In the example shown, the mattress is provided with a plurality of parallel elongate elements disposed on its bottom face. These elements may also be disposed on its top face, i.e. on the face of the mattress that is opposite from the face facing towards the bottom of the cavity when the mattress is in the fastened state inside the cavity or at a location close to it. The elongate elements may be fastened to the mattress by adhesive bonding, heat-sealing, or by some other fastening means.

The cover device further comprises a support structure 2 for fastening the cover element 3 inside or at a location close to the cavity 1 to be covered so that the support structure 2 extends substantially parallel to a side of said cavity that is preferably a longitudinal side. Preferably, said support structure 2 is in the form of a case 2 inside which the cover element is at least partially inserted when in the most compact configuration. Said case 2 is provided with an opening 2*d* through which the cover element projects while it is going from the most compact configuration to the least compact configuration. This case makes it possible to protect the cover element from any damage while work is being done in the cavity.

Figure 4:
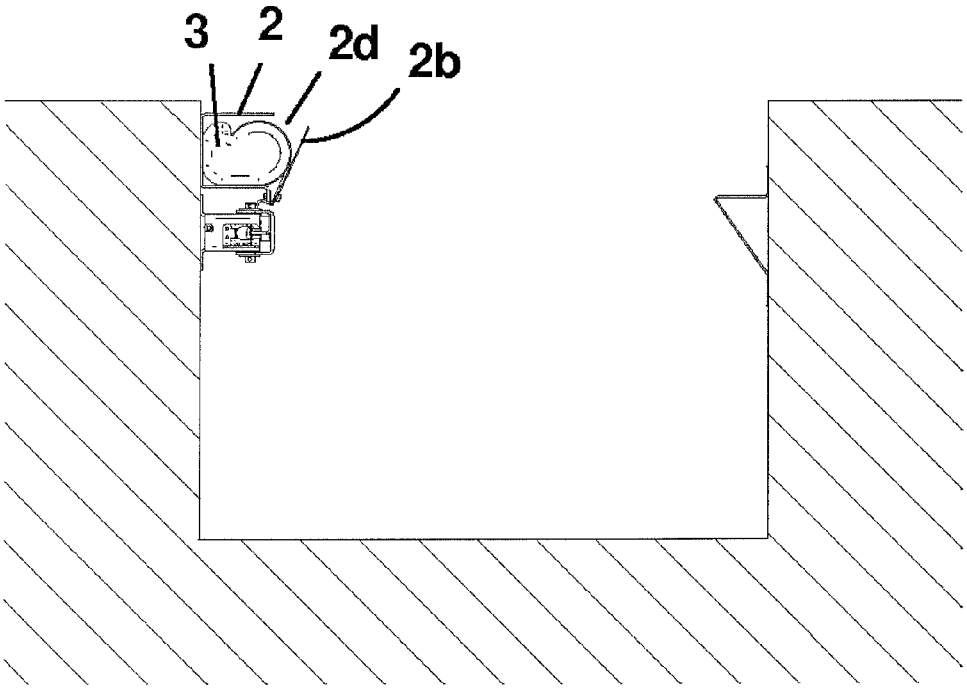
Figure 5:
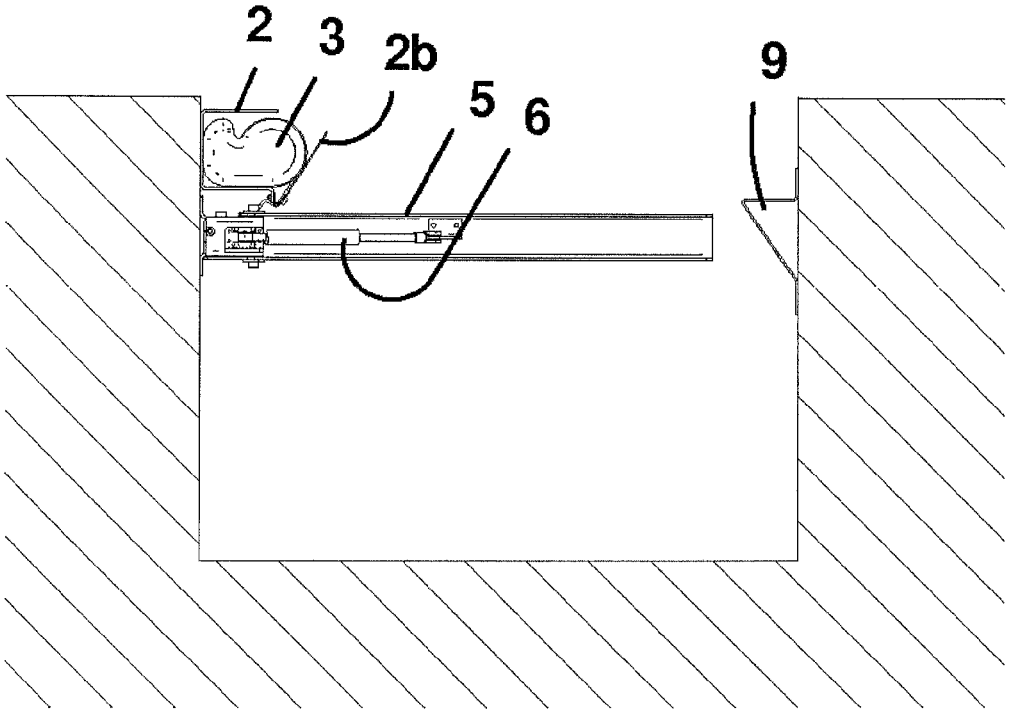
Figure 6:
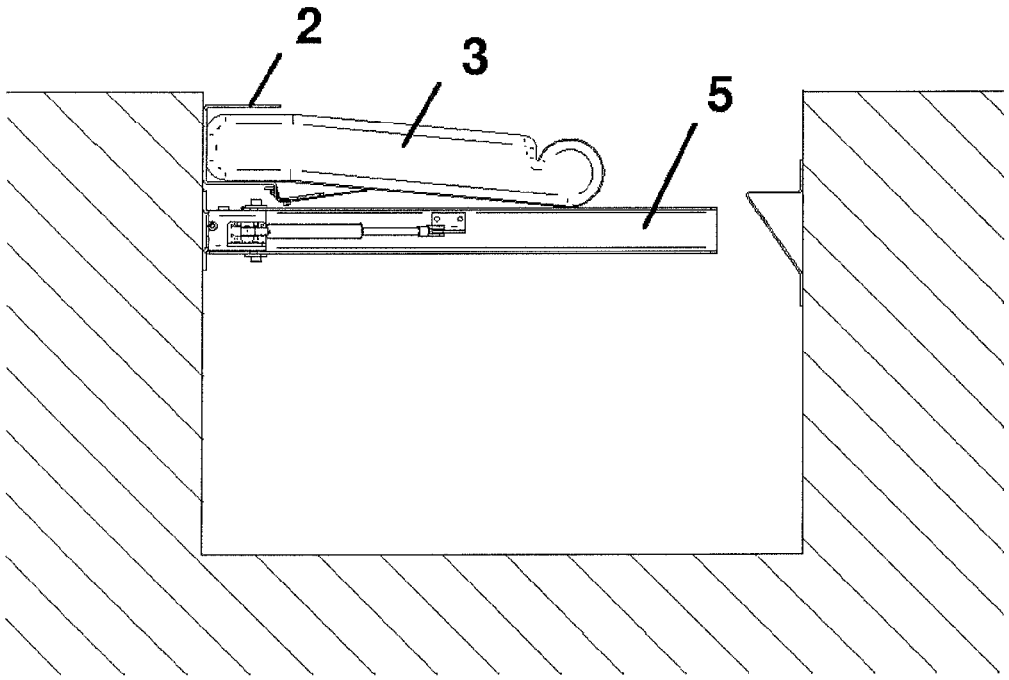
Figure 7:
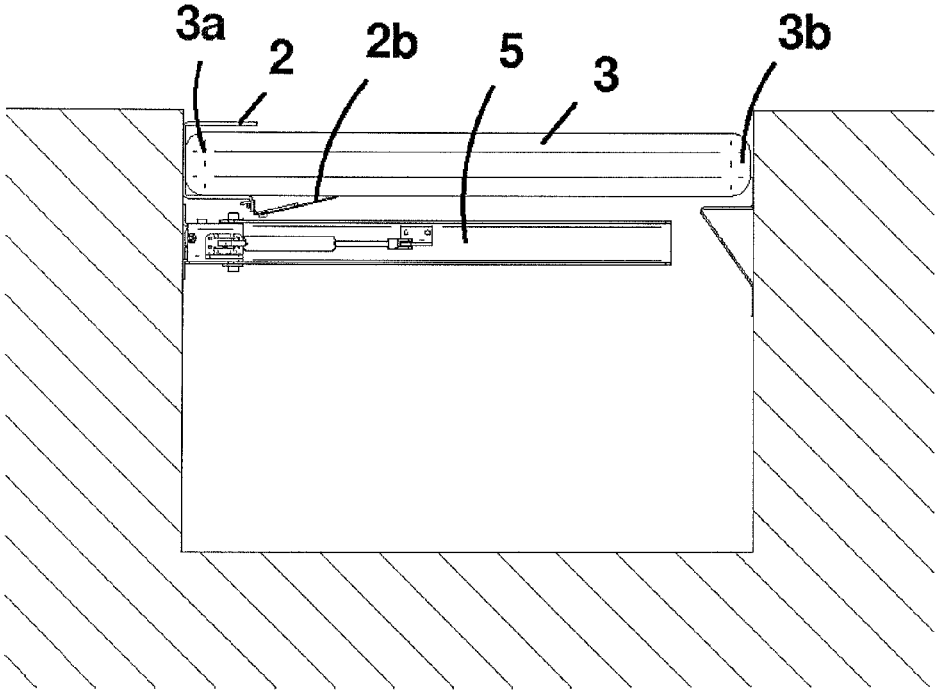

The opening 2*d* of the case 2 is provided with a closure element, which, in this example, is formed of a flap 2*b*, mounted to move between a closed position in which it closes said case 2, and an open position in which it opens said case 2. This closure element 2 for closing the case is a pivotally mounted element that is mounted to pivot about an axis that is parallel to the longitudinal axis of the case, and said closure element is connected to the remainder of the case via spring-loaded hinges that form the return means 7 for urging the closure element 2*b* back into the closed position in which it closes the case 2. The closure element 2*b* is subjected to the pressure of the mattress, while the mattress is being inflated, as shown in FIG. 4, thereby enabling said closure element 2*b* to pivot and to go from the closed position to the open position. In its most compact configuration, the mattress 3 is rolled up about a free one 3*b* of its sides and forms a spirally wound roll, said free side 3*b* about which the mattress 3 is rolled up being formed by the side of the mattress that is opposite from the connecting side 3*a* via which the mattress is connected to the support structure 2. The support structure 2 that constitutes the connection interface between the mattress and the cavity comes itself to be inserted, for example, in a rabbet provided along one of the longitudinal sides of the cavity and is held inside said rabbet, e.g. by screws.

In a manner characteristic of the invention, said device further comprises at least one support arm 5 for supporting said mattress 3 while the mattress is going from its most compact configuration to its least compact configuration, said support arm 5 being mounted to move between a stowage position in which it extends substantially parallel to the roll-up axis about which the mattress 3 is rolled up and a working position in which it extends transversely to said roll-up axis.

In this example, the or each support arm 5 is a pivotally mounted arm mounted to pivot about a "vertical" axis perpendicular to the bearing plane formed by the mattress in the inflated state and perpendicular to the roll-up axis about which said mattress is rolled up or to the longitudinal axis of said support structure.

The or each support arm 5 is equipped with return means 6 for urging said support arm 5 back into the working position.

In the examples shown, these return means 6 are formed by a linkage or by a gas actuator. These resilient return means 6 may, in equivalent manner, be formed by a spring.

The or each support arm 5 is caused to move automatically for causing said support arm 5 to go from the stowage position to the working position, and is caused to move manually for causing said support arm 5 to go from the working position to the stowage position.

In particular the device further comprises holding means 8 for holding the or each support arm 5 in the stowage position, at least a portion 8A of the holding means 8 being carried by the closure element 2*b* and being mounted to be constrained to move with said closure element 2*b*, said portion 8A of the holding means 8 being activatable/deactivatable and being suitable, while the closure element is going from the closed position to the open position, for going from the active position in which it holds the support arm 5 in the stowage position to the inactive position in which it releases the support arm 5 and allows it to move towards its working position.

At least a portion 8B of the holding means 8 of the or each support arm 5 is disposed on the moving portion of the support arm 5. This portion 8B of the holding means 8 comprises at least one retractable member that retracts while the support arm 5 is going from the working position to the stowage position by coming into bearing contact with the portion 8A of the holding means 8 carried by the closure element 2*b* and that redeploys when the support arm 5 is in the stowage position so as to co-operate with the portion 8A of the holding means 8 carried by the closure element 2*b* to form the locking member for locking said support arm 5.

In the examples shown, the locking member that constitutes the portion 8B of the holding means 8 that is carried by the support arm 5 is in the form of a member, such as a spring-loaded stud or lug, and the portion 8A of the holding means 8 that is carried by the closure element 2*b* is in the form of an abutment, projecting from the closure element 2*b*, and moving with the closure element 2*b*, which abutment, when the closure element 2*b* is in the closed position, is disposed in the path followed by the support arm 5, in particular the locking member of the support arm 5, while the support arm 5 is going between its stowage position and its working position, and out of said path, when the closure element 2*b* is in the open position.

Figure 8:
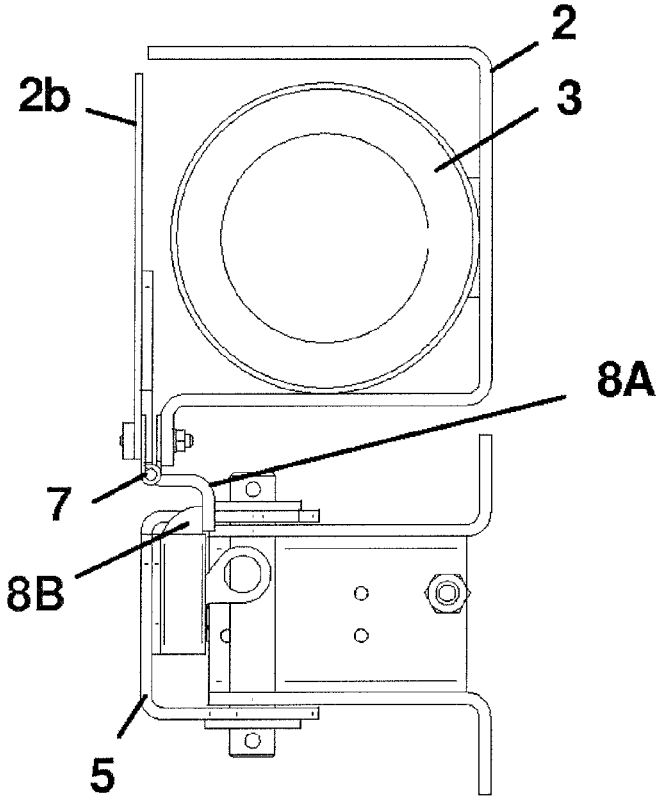
FIGS. 8 to 10 are diagrammatic section views of the device showing how the support arm is unlocked by opening the closure element.
Figure 9:
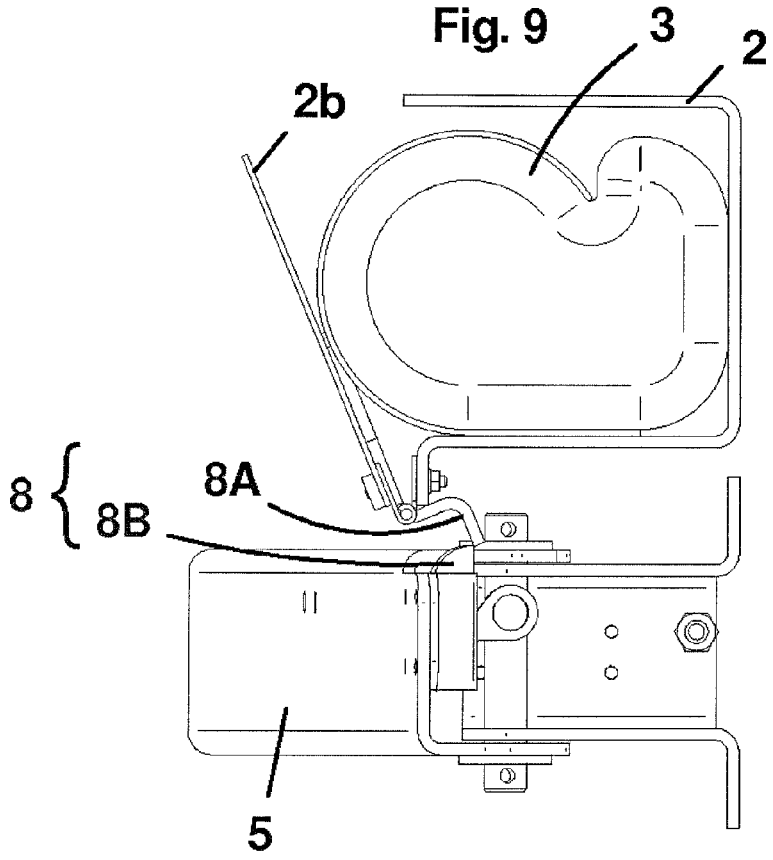
Figure 10:
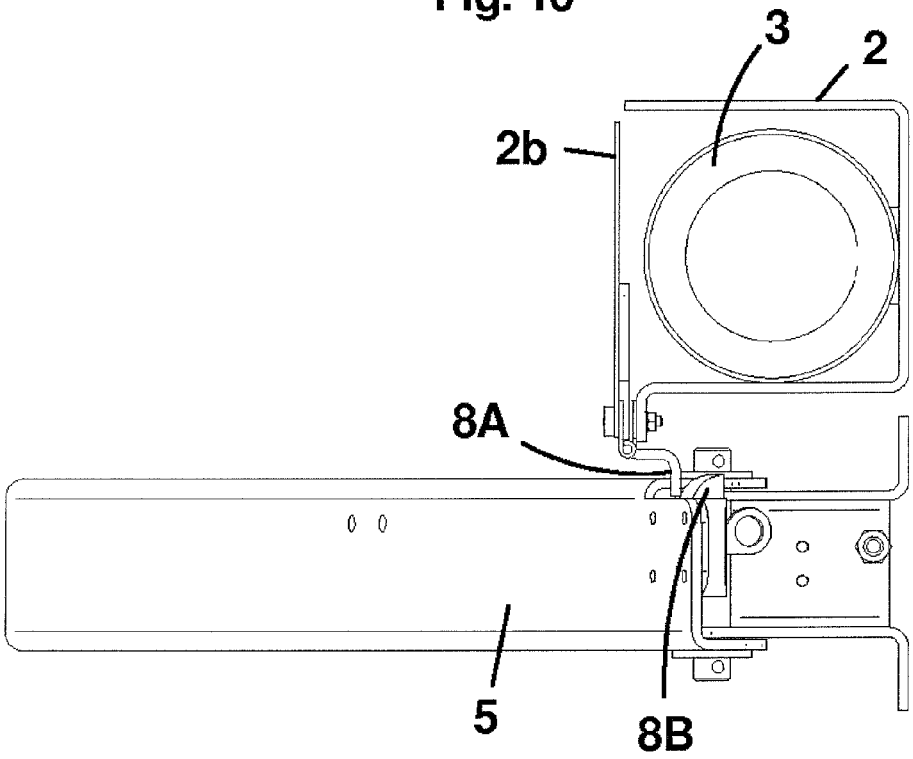

These holding means can be seen more particularly in FIGS. 8 to 10. In this embodiment, the abutment projecting from the closure element extends projecting from the bottom face of the case, and the locking member carried by the moving portion of the support arm 5 is formed by a spring-loaded bolt that is urged back into the bearing position in which it bears against said abutment. The abutment and the locking member are disposed, relative to the arm, on the same side of the pivot axis of the arm, on the shorter arm portion that tends to remain under the case while the arm is moving pivotally by being urged to pivot by its return means 6. During this pivotal movement, said arm comes to bear against a stationary abutment corresponding to the end of the stroke of the arm in the working position, this stationary abutment being disposed once more under the bottom face of the case.

The operating principle of such a cover device is as follows. In a first stage, the cover device is installed relative to the cavity 1 and the support structure 2 is fastened along one side, such as a longitudinal side, of the cavity. Generally, the cover element is in the most compact configuration and is housed inside the case with the flap of the case being in the closed position during this installation operation. For using the device, in particular for deploying the mattress, the mattress is inflated, thereby causing the flap to pivot in the direction in which it opens the case. The flap opening in this way causes the abutment carried by said flap to retract, thereby releasing the support arm 5 and enabling said support arm to pivot under the action of its return means 6 so as to go from a position in which it extends under the support structure to a position in which it extends under the bearing plane formed by the mattress in the least compact position. In parallel, the mattress 3 in turn deploys by rolling out from its connecting side via which it is connected to the support structure until it extends to the opposite side of said cavity and comes to bear against bearing means 9 positioned along the opposite side of the cavity when such bearing means are present. The mattress thus closes off the opening of said cavity in the zone over which it extends. In equivalent manner, the mattress could be disposed, for example, along the middle longitudinal axis of the cavity and could extend on either side of said middle longitudinal axis. It would then be necessary to have two cover devices in order to cover the entire width of said cavity.

For causing the cavity 1 to go to its open position, it suffices to deflate the mattress, e.g. by allowing it to deflate by means of the valve equipping the orifice for inflating the mattress.

The return means 4 then exert on the mattress a force that is greater than the force exerted by the inflation means, i.e., in this example, greater than the air pressure prevailing inside said mattress so that, under the action of said return means, the mattress rolls up again and returns to its most compact configuration. In this configuration, the closure element 2 of the case closes again automatically under the action of its return means 7. The or each support arm 5 is then brought back manually by the operator into its stowage position.

During this movement, the locking member that equips the moving portion of the support arm 5 retracts by coming into bearing contact with the abutment equipping the closure element 2*b*, so as to go past said abutment and then redeploy once it is past the abutment, and is held in bearing contact thereagainst via the return means 6 of the arm.

By means of the design of the cover element, the operations for opening and closing the cavity take place easily and quickly. Such a cover device is easy to maintain because of its simplicity. When the cavity is equipped with a plurality of cover devices disposed in the form of an alignment, e.g. along one of the longitudinal sides of the cavity, each cover element may be inflated or deflated simultaneously with cover elements of the adjacent or non-adjacent cover devices. As a result, and as shown in FIG. 1, it is possible to have a cover element in its most compact configuration while the adjacent cover element is positioned in its least compact configuration.

As mentioned below, for the purposes of inflating/deflating it, the mattress is connected via a pneumatic circuit to an air feed source. For safety reasons, the pneumatic circuit between the inflation and deflation orifice of the mattress and the air feed source of said circuit may include at least two air discharge outlets, one of which is closed during the mattress inflation stage and is suitable for going from the closed position to the open position for the mattress deflation step, and the other of which is calibrated, i.e. it is suitable for allowing air to escape beyond a predetermined inflation pressure to which the mattress is inflated, said calibrated air discharge outlet that is open during the inflation stage being closed when the mattress is in the rolled-out least compact configuration. For the purpose of causing the calibrated air discharge outlet to go from the open position to the closed position and vice versa, the cover device is provided with a control member disposed at the bearing means 9 for bearing against the free roll-up side 3*b* of the mattress when said mattress is in the rolled-out state. For example, this control member may be disposed in the bottom of the rail forming said bearing means 9. This control member is activatable/deactivatable merely under the action of the pressure exerted by the free side of the mattress on said control member. The presence of said calibrated air discharge outlet makes it possible to avoid an accident involving the operator being squeezed or trapped between the mattress and the side of the pit during the mattress inflation stage.

The invention claimed is:

1. A cover device for at least partially closing off an open-top cavity of one of a pit and a pool to prevent items falling into said cavity, the device comprising:

at least one cover element for at least partially closing off an opening of the cavity; and a support structure configured to support the cover element, the support structure being an elongate body configured to position the cover element in or close to the cavity along one of sides of the opening of the cavity; and at least one support arm, wherein the cover element is a pneumatic mattress equipped with a mattress return means for urging the mattress back into a most compact configuration in which the mattress is rolled up about a free one of mattress sides and forms a spirally wound roll, the free side about which the mattress is rolled up being formed by the side of the mattress that is opposite from a connecting side of the mattress via which the mattress is connected to the support structure, the mattress being an inflatable mattress so that, by being rolled out, the mattress can move from its rolled-up most compact configuration, in which the mattress is configured to at least partially open up the opening of the cavity to a rolled-out least compact configuration in which is configured to at least partially close the opening of the cavity, and the at least one support arm is configured to support the mattress while the mattress moves from the rolled-up most compact configuration to the rolled-out least compact configuration, the support arm being mounted to move between a stowage position in which the support arm extends substantially parallel to a roll-up axis about which the mattress is rolled up and a working position in which the support arm extends transversely to the roll-up axis.

2. The device according to claim 1, wherein the at least one support arm is equipped with a support arm return means for urging the support arm back into the working position.

3. The device according to claim 1, the at least one support arm is configured to move automatically from the stowage position to the working position, and is configured to move manually from the working position to the stowage position.

4. The device according to claim 1, wherein the support structure is in the form of a case inside which the cover element is at least partially inserted when the cover element is in the rolled-up most compact configuration, the case being provided with an opening through which the cover element projects while the cover element is moving from the rolled-up most compact configuration to the rolled-out least compact configuration, the opening of the case being provided with a closure element, mounted to move between a closed position in which the closure element closes the case and an open position in which the closure element opens the case.

5. The device according to claim 4, wherein the closure element is equipped with closure element return means for urging the closure element back into the closed position in which the closure element closes the case and is configured to move from the closed position to the open position under the effect of the pressure exerted by the mattress on the closure element, while the mattress is being inflated.

6. The device according to claim 3, further comprising a holding means for holding the at least one support arm in the stowage position, at least a first portion of the holding means being carried by the closure element and being mounted to be constrained to move with the closure element, the first portion of the holding means being activatable/deactivatable and being configured, while the closure element is moving from the closed position to the open position, to move from an active position in which the portion of the holding means holds the support arm in the stowage position to an inactive position in which the portion of the holding means releases the support arm and allows the support arm to move towards the working position.

7. The device according to claim 6, wherein at least a second portion of the holding means for holding the at least one support arm is disposed on a moving portion of the support arm, the second portion of the holding means comprising at least one retractable member that retracts while the support arm is moving from the working position to the stowage position by coming into bearing contact with the first portion of the holding means carried by the closure element and that redeploys when the support arm is in the stowage position so as to co-operate with the first portion of the holding means carried by the closure element to form a locking member for locking the support arm.

8. The device according to claim 7, wherein the locking member that constitutes the second portion of the holding means that is carried by the support arm is in the form of a member, the member being one of a spring-loaded stud or lug, and the first portion of the holding means that is carried by the closure element is in the form of an abutment, projecting from the closure element, and moving with the closure element, the abutment being disposed in a path followed by the locking member of the support arm when the closure element is in the closed position, while the support arm is moving between the stowage position and the working position, and out of said path when the closure element is in the open position.

9. The device according to claim 1, wherein the mattress return means for urging the mattress back into the most compact rolled-up configuration are elastically deformable elements, each of which is in the form of an elongate element extending between the free side of the mattress about which the mattress is configured to be rolled up in the most compact configuration and the connecting side of the mattress opposite from the free side via which the mattress is connected to the support structure.

10. The device according to claim 1, further comprising bearing means for bearing against the free side of the mattress, about which the mattress is rolled up, the bearing means being in the form of one or more elongate rail elements that are positionable along one of the sides of the opening of the cavity that is opposite from the side of the cavity that receives the support structure so as to form an additional bearing surface against which the mattress can bear.

11. A vehicle repair installation, comprising:

at least a cavity; and a cover device configured to close off an opening of the cavity, the cover device being the device according to claim 1.

12. A method of at least partially closing off the cavity of the pit or the pool type the device according to claim 1, the method comprising:

fastening the device in the cavity or at a location close to the cavity;

inflating said the pneumatic mattress to cause the mattress to move from its most compact configuration to its least compact configuration in which the mattress at least partially closes off the cavity, during the inflating, causing the support arm to move from the stowage position to the working position of the support arm; and allowing the inflatable mattress to deflate in such manner as to enable the mattress to be rolled up via the return means when the cavity is in an at least partially closed-off state and in order to open up the cavity at least partially.

13. The device according to claim 2, the at least one support arm is configured to move automatically from the stowage position to the working position, and is configured to move manually from the working position to the stowage position.

14. The device according to claim 13, further comprising a holding means for holding the at least one support arm in the stowage position, at least a first portion of the holding means being carried by the closure element and being mounted to be constrained to move with the closure element, the first portion of the holding means being activatable/deactivatable and being configured, while the closure element is moving from the closed position to the open position, to move from an active position in which the portion of the holding means holds the support arm in the stowage position to an inactive position in which the portion of the holding means releases the support arm and allows the support arm to move towards the working position.

* * * * *